United States Patent [19]

Emmerich

[11] Patent Number: 4,678,238

[45] Date of Patent: Jul. 7, 1987

[54] COOLANT SLEEVE FOR MINING TOOLS

[75] Inventor: Kenneth C. Emmerich, Lexington, Ky.

[73] Assignee: Fansteel Inc., North Chicago, Ill.

[21] Appl. No.: 840,155

[22] Filed: Mar. 17, 1986

[51] Int. Cl.[4] ..... E21C 35/22; E21F 5/02

[52] U.S. Cl. ..... 299/81; 299/91

[58] Field of Search ..... 299/81, 12, 86, 17, 299/91-93; 175/67

[56] References Cited

U.S. PATENT DOCUMENTS

| | | | |
|---|---|---|---|
| 3,499,685 | 3/1970 | Kniff | 299/86 |
| 3,575,467 | 4/1971 | Davis | 299/92 |
| 4,333,687 | 6/1982 | Barnstorf | 299/81 |

FOREIGN PATENT DOCUMENTS

| | | | |
|---|---|---|---|
| 10534 | 4/1980 | European Pat. Off. | 299/81 |
| 2092205 | 8/1982 | United Kingdom | 299/91 |

*Primary Examiner*—Stephen J. Novosad
*Assistant Examiner*—Michael A. Goodwin
*Attorney, Agent, or Firm*—Barnes, Kisselle, Raisch, Choate, Whittemore & Hulbert

[57] ABSTRACT

A coolant system for mining bits which are rotatably mounted in blocks secured to mining machines of the type utilizing a large rotating wheel or continuous power-driven chains. The mounting blocks for the bits have a coolant passage leading to a bore in the block. Within the bore is a coolant dispensing sleeve which has a central passage to receive the shank of a mining bit. The sleeve has one or more axially disposed spray nozzles which receive coolant under pressure from the coolant passage in the block and from an annular passage formed between the block and the sleeve.

2 Claims, 2 Drawing Figures

COOLANT SLEEVE FOR MINING TOOLS

FIELD OF INVENTION

Mining tool bits utilizing a shank and cutting tip which are mounted on a power-driven machine such as a large rotating wheel to abrade the ceiling or walls of an area being mined, and the furnishing of coolant to respective bits.

BACKGROUND OF INVENTION

Cutting and tunneling machines in the mining field utilize power-driven continuous chains or large diameter power-driven wheels which carry circumferentially spaced cutting bits having wear points projecting from the wheel to dig into and abrade the material to be removed from the mining area. In some areas, it has been the practice to supply a coolant to an area near each cutting point to lower the temperature of the bit and thus improve its life and also to wash the dust and fines away from the bit.

Examples of devices which furnish coolant in this manner are found in the following U.S. patents:

| | | |
|---|---|---|
| Barnstorf | 4,333,687 | June 8, 1982 |
| Clemmow | 4,453,775 | June 12, 1984 |
| Bergqvist | 4,488,759 | Dec. 18, 1984 |
| Zitz et al | 4,506,932 | Mar. 26, 1985 |

The present invention has as an object the provision of a coolant system in combination with a wear sleeve which allows the cutting bit to rotate and thus even the wear, and also reduces the wear on the mounting block secured to the rotating wheel.

A further object is a simplified and thus lower cost system for applying coolant which is also more rugged for the extreme wear conditions which pertain in the mining field.

A further object is the provision of a structure which permits a quick change of the bit and sleeve in the block and the substitution, when desired, of a sleeve with a modified nozzle when conditions call for such a substitution to vary the water spray.

A still further object is the provision of a coolant sleeve and bit mounting which provides increased service life of the three elements, namely, the bit, the sleeve and the mounting block.

Other objects and features of the invention will be apparent in the following description, accompanying drawings, and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
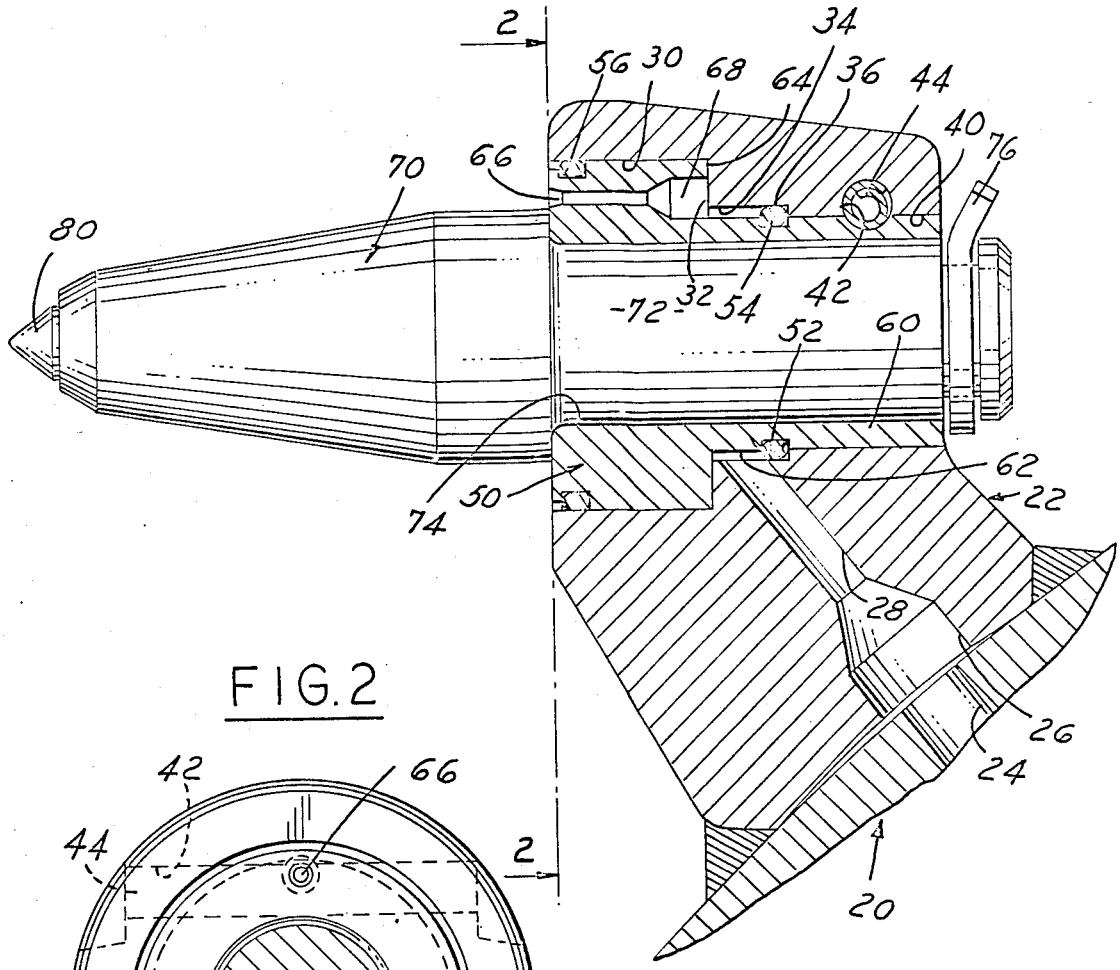
FIG. 1, a vertical sectional view of the coolant sleeve and mounting block with bit in place.
Figure 2:
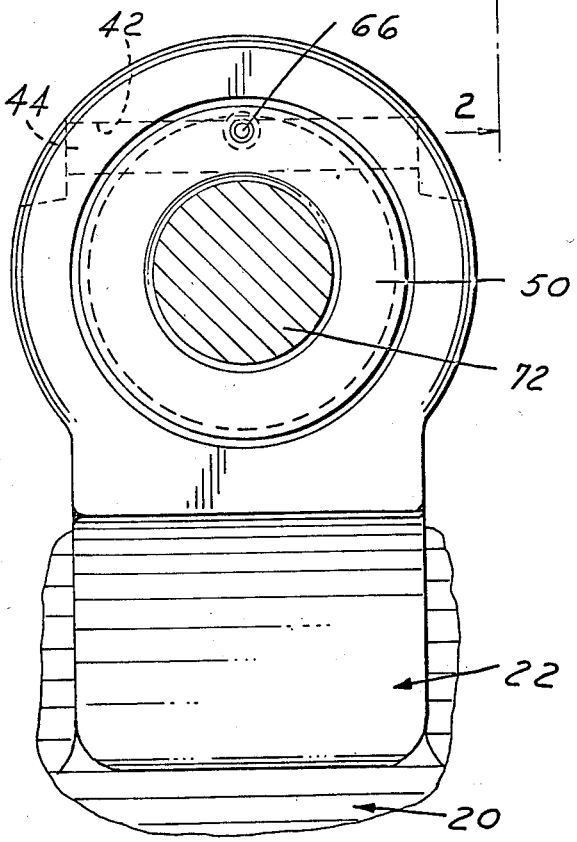
FIG. 2, a sectional view taken on line 2—2 of FIG. 1.

In FIG. 1, a portion of the periphery of a mining machine wheel 20 is illustrated having mounted on the periphery a mounting block 22. The wheel 20 has a coolant passage 24 which registers with a port 26 in block 22 opening to a central passage 28.

In the mounting block 22 is a stepped bore extending in somewhat tangential relationship to the wheel 20. This bore has a large diameter entrance section 30 which steps down at a shoulder 32 to an intermediate bore 34 terminating at a shoulder 36 which steps down to the smallest bore 40. The shoulder 32 provides an axial load bearing surface.

Transverse to and tangential to the bore 40 is a cross-passage 42 to receive a roll pin 44 or other retainer pin.

Within the stepped bore in block 22 is a two-step sleeve 50 which has the smaller portion fitted into the bore 40 and suitably notched to receive the retainer pin 44. An O-ring groove 52 receives an O-ring 54 which lodges against shoulder 36 between bores 34 and 40. A second O-ring groove near the mouth of bore 30 receives an O-ring 56 to seal the mouth of the bores. The inner end 60 of the collar 50 has a diameter to fit into bore 40 but smaller than bore 34. This leaves an annular passage 62 to adjacent shoulder 32 which is in communication with the coolant passage 28. The collar 50 has a radial shoulder 64 which bears against shoulder 32 in the block 22 to carry the axial thrust of the bit.

An axial passage 66 in collar 50 originates at a port 68 at shoulder 64 in communication with annular passage 62, and the passage 66 opens to the forward end of the collar 50 adjacent the surface of the working end of a mining bit 70. The bit 70 is of standard construction with a mounting shank 72 which fits rotatably in the center bore 74 of the collar 50. An exposed and grooved end of the shank can carry a retainer clip 76 which snaps into position. The exposed end of the bit 70 has a wear tip 80.

In operation, of course, the wheel 20 will be fitted with numerous blocks 22 around its periphery and a source of fluid under pressure will be provided within the wheel to respective points at the periphery. Coolant will flow through passages 24, 26, 28, 62 and 68 to the outlet passage 66 where it will spray out to the cutting end of the bit 70. Various spray patterns can be provided as desired. The O-rings seal the annular surface of the collar to prevent loss of coolant pressure. Since the bit normally rotates in the sleeve, the single spray outlet 66 usually is sufficient to provide coolant to the working end of the bit. Additional spray outlet passages can be provided, if desired.

What is claimed is:

1. A mining bit mount for standard mining bits for use on a power-driven mining machine with a source of liquid coolant which comprises:

(a) a one-piece, integral, valve-less mounting block to be secured to a moving element of a mining machine, said block having a stepped bore with an outer end to be adjacent the working end of a mining bit and an inner end spaced axially from said outer end, said bore being disposed on a first axis coincident with an axis on which a mining bit is to be mounted, said bore being a stepped passage having the larger end at the outer end, the smaller end at the inner end to provide an annular axial support shoulder between the larger end and the smaller end of the said bore, said block having a coolant passage opening to said stepped bore, (b) a one-piece, integral, valve-less two-step sleeve fitted within said stepped bore having an axial bore to receive a mounting shank of a cutting bit, and a large end to interfit with said larger end of said stepped bore with a radial shoulder to seat on said annular support shoulder in said block and a smaller end to interfit with said smaller end of said stepped bore, and means between the wall of said stepped bore of said mounting block and the said sleeve to form an annular unrestricted passage open to said coolant passage in said block, (c) an axially extending unrestricted passage formed in said sleeve in constant communication with said annular passage having a spray outlet directed axially along the mining bit, and (d) a retainer means to interfit with a notch in said sleeve to lock said sleeve axially and rotationally in said stepped bore of said mounting block.

2. A mining bit mount for use on a power-driven mining machine with a source of liquid coolant which comprises:

(a) a one-piece, integral, valve-less mounting block to be secured to a moving element of a mining machine, said block having a three-step bore with an outer end to be adjacent the working end of a mining bit and an inner end spaced axially from said outer end, said three-step bore being disposed on a first axis of coincident with an axis on which a mining bit is to be mounted, said three-step bore being a three-step passage having the largest end at the outer end and the smallest end at the inner end to provide an annular axial support shoulder between the largest end and the smallest end of the said bore, a central bore between said largest and smallest ends with an intermediate diameter and said block having a coolant passage opening to said central bore, (b) a one-piece, integral, valve-less two-step sleeve fitted within said three-step bore and having an axial bore to receive a mounting shank of a cutting bit, and a large end to interfit with said largest end of said three-step bore with a radial shoulder to seat on said annular support shoulder in said block and a smaller end to interfit with said smallest end of said three-step bore, a portion of said smaller end of said sleeve axially overlying said central bore in said block to form an unrestricted annular passage around said sleeve within said mounting block, (c) an axially extending unrestricted passage formed in said sleeve in constant communication with said annular passage having a spray outlet directed axially along the mining bit, and (d) a retainer means to interfit with a notch in said sleeve to lock said sleeve axially and rotationally in said three-step bore of said mounting block.

* * * * *